US008959733B2

(12) United States Patent
Sekiguchi et al.

(10) Patent No.: US 8,959,733 B2
(45) Date of Patent: Feb. 24, 2015

(54) METHOD OF MANUFACTURING LIQUID TRANSPORTING APPARATUS

(75) Inventors: Yasuhiro Sekiguchi, Nagoya (JP); Takamasa Usui, Gifu (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 937 days.

(21) Appl. No.: 12/718,116

(22) Filed: Mar. 5, 2010

(65) Prior Publication Data

US 2010/0223768 A1 Sep. 9, 2010

(30) Foreign Application Priority Data

Mar. 5, 2009 (JP) ..... 2009-051814
Mar. 30, 2009 (JP) ..... 2009-081404

(51) Int. Cl.
*B41J 2/16* (2006.01)
*B41J 2/14* (2006.01)

(52) U.S. Cl.
CPC ..... *B41J 2/161* (2013.01); *B41J 2/14233* (2013.01); *B41J 2/1623* (2013.01); *B41J 2/1634* (2013.01); *B41J 2002/14258* (2013.01); *B41J 2002/14491* (2013.01)
USPC ..... 29/25.35; 29/890.1; 29/832; 29/852; 347/68; 347/71

(58) Field of Classification Search
CPC .... B41J 2/14233; B41J 2/161; B41J 2/16233; B41J 2/1634; B41J 2002/14491; B41J 2002/14253; B41J 2/1623; B41J 2002/14258
USPC ..... 29/25.35, 890.1, 832, 834, 852; 347/68–72
See application file for complete search history.

(56) References Cited

U.S. PATENT DOCUMENTS 4,642,160 A * 2/1987 Burgess ..... 29/852 X
7,219,428 B2 * 5/2007 Ito ..... 29/25.35 X (Continued)

FOREIGN PATENT DOCUMENTS

JP 05286132 A * 11/1993 ..... 29/890.1
JP 2002/240278 8/2002

(Continued)

*Primary Examiner* — A. Dexter Tugbang
(74) *Attorney, Agent, or Firm* — Frommer Lawrence & Haug LLP

(57) ABSTRACT

There is provided a method of manufacturing liquid transporting apparatus including: providing a channel unit; providing a piezoelectric actuator having a first and second active portion corresponding to a central portion and an outer periphery portion of the pressure chamber, respectively. The first and second active portions are sandwiched between an upper electrode and an intermediate electrode, and between the upper electrode and a lower electrode, respectively. The method further includes joining the channel unit and the piezoelectric actuator by positioning such that the intermediate electrode overlaps the central portion of the pressure chamber. Accordingly, since it is possible to make the first active portion overlap the central portion of the pressure chamber, it is possible to apply a appropriate pressure to the liquid in the pressure chamber without excessively small deformation of the first active portion.

11 Claims, 9 Drawing Sheets

(56) References Cited

U.S. PATENT DOCUMENTS

| | | | | |
|---|---|---|---|---|
| 2001/0005213 | A1* | 6/2001 | Ikeda et al. | 347/70 |
| 2002/0113847 | A1 | 8/2002 | Takagi et al. | |
| 2003/0067510 | A1 | 4/2003 | Isono | |
| 2003/0068510 | A1 | 4/2003 | Butera et al. | |
| 2003/0107622 | A1 | 6/2003 | Sugahara | |
| 2003/0142173 | A1 | 7/2003 | Takahashi | |
| 2003/0218658 | A1 | 11/2003 | Ito | |
| 2004/0008241 | A1 | 1/2004 | Junhua | |
| 2005/0068380 | A1 | 3/2005 | Ito | |
| 2006/0038859 | A1 | 2/2006 | Sugahara | |
| 2006/0082618 | A1 | 4/2006 | Ito | |
| 2006/0152556 | A1 | 7/2006 | Sugahara | |
| 2007/0176978 | A1* | 8/2007 | Sugahara | 347/68 |
| 2009/0096844 | A1 | 4/2009 | Kojima et al. | |

FOREIGN PATENT DOCUMENTS

| | | | |
|---|---|---|---|
| JP | 2003112423 | | 4/2003 |
| JP | 2003/224312 | | 8/2003 |
| JP | 2003334948 | | 11/2003 |
| JP | 2004048985 | | 2/2004 |
| JP | 2004166463 | | 6/2004 |
| JP | 2004304027 | | 10/2004 |
| JP | 2005/096350 | | 4/2005 |
| JP | 2006110824 | | 4/2006 |
| JP | 2006264140 | | 10/2006 |
| JP | 2007203550 | A * | 8/2007 |
| JP | 2009096173 | | 5/2009 |

* cited by examiner

METHOD OF MANUFACTURING LIQUID TRANSPORTING APPARATUS

CROSS REFERENCE TO RELATED APPLICATION

The present application claims priority from Japanese Patent Application No. 2009-051814, filed on Mar. 5, 2009, and Japanese Patent Application No. 2009-081404, filed on Mar. 30, 2009, the disclosure of which are incorporated herein by reference in their entirety.

BACKGROUND OF THE INVENTION

1. Field of the Invention

The present invention relates to a method of manufacturing liquid transporting apparatus of transporting a liquid by applying a pressure to the liquid in a pressure chamber.

2. Description of the Related Art

In various fields, liquid transporting apparatuses having a piezoelectric actuator which applies a pressure to a liquid, have hitherto been known. For instance, an ink-jet head having a piezoelectric actuator which applies a pressure to an ink for jetting from a nozzle has been known.

This ink-jet head includes a channel unit (a cavity unit) and a piezoelectric actuator. The channel unit includes ink channels in which a plurality of nozzles and a plurality of pressure chambers communicating with the plurality of nozzles respectively are formed. The piezoelectric actuator is joined to the channel unit to cover the plurality of pressure chambers. Moreover, the piezoelectric actuator has a plurality of stacked piezoelectric layers (piezoelectric sheets), and individual electrodes and a common electrode which are arranged in an area facing the pressure chambers. The piezoelectric layers are sandwiched by the individual electrodes and the common electrode in a thickness direction of the piezoelectric layers. Moreover, when a voltage is applied between one of the individual electrodes and the common electrode, an electric field in the thickness direction acts in a portion of the piezoelectric layer (an active portion) sandwiched between the individual electrode and the common electrode. The piezoelectric actuator changes a volume of the pressure chamber to apply a pressure to the ink in the pressure chamber by using a deformation (piezoelectric distortion) which is generated in the piezoelectric layer due to the electric field.

SUMMARY OF THE INVENTION

One of the inventors of the present invention have proposed a piezoelectric actuator 32 as shown in FIG. 6, as a piezoelectric actuator having a novel structure. In this piezoelectric actuator 32, a lower piezoelectric layer 41 and an upper piezoelectric layer 42 are arranged to be stacked in this order on a surface of a vibration plate 40 which is arranged on an upper surface of a channel unit, and a second constant electric potential electrode 43, a first constant electric potential electrode 44*a*, and individual electrodes 45 are formed on an upper surface of the vibration plate 40, an upper surface of the lower piezoelectric layer 41, and an upper surface of the upper piezoelectric layer 42, respectively. Moreover, a portion of the upper piezoelectric layer 42 (a first active portion R1), which is sandwiched between the first constant electric potential electrode 44*a* and one of the individual electrodes 45 and which faces a central portion of one of the pressure chamber 10, is polarized in a direction from the first constant electric potential electrode 44*a* toward the individual electrode 45. Whereas, a portion of the lower and upper piezoelectric layers 41, 42 (a second active portion R2), which faces one of the pressure chambers 10, which is sandwiched between one of the individual electrodes 45 and the second constant electric potential electrode 43, and which is arranged on an outer periphery of the first active portion R1 in a plan view, is polarized in a direction from the individual electrode 45 toward the second constant electric potential electrode 43.

Such piezoelectric actuator switches an electric potential of one of the individual electrodes 45 selectively to a ground electric potential and a positive electric potential, while the second constant electric potential electrode 43 is kept at the ground electric potential and the first constant electric potential electrode 44*a* is kept at a predetermined positive electric potential (such as about 20V). Moreover, it is possible to deform the first active portions and the second active portions by switching the electric potential of the individual electrodes. Therefore, it is possible to deform the portion, of the vibration plate 40 and the lower and upper piezoelectric layers 41, 42, facing one of the pressure chambers to form a projection toward the pressure chamber, or to form a projection toward an opposite side of the pressure chamber. In this manner, the pressure is applied to the ink in the pressure chamber when a volume of the pressure chamber is changed substantially by deforming the lower and upper piezoelectric layers 41, 42, and the vibration plate 40.

In such piezoelectric actuator, unlike in a case in which a position of the individual electrodes is shifted from a position overlapping with central portions of the pressure chambers in a plan view, when a position of the first constant electric potential electrode 44*a* is shifted from a position overlapping with the central portions of the pressure chambers in a plan view, a position of the first active portions shifts from a position overlapping with the central portion of the one of the pressure chambers in a plan view. As the position of the first active portions is shifted, an amount of displacement of a portion of the piezoelectric layer facing the pressure chamber due to the deformation generated in the first active portions becomes small, and it is not possible to apply a predetermined pressure to the liquid in the pressure chamber formed in the channel unit.

Therefore, an object of the present invention is to provide a method of manufacturing a liquid transporting apparatus in which it is possible to arrange the first constant electric potential electrode to overlap the central portion of the pressure chamber such that the first active portion overlaps the central portion of the pressure chamber, and to apply a pressure to the liquid in the pressure chamber without an amount of displacement of the piezoelectric layer due to the deformation generated in the first active portion becoming small.

According to an aspect of the present invention, there is provided a method of manufacturing a liquid transporting apparatus which transports a liquid, including:

providing a channel unit in which a liquid transporting channels including a pressure chamber is formed;

providing a piezoelectric actuator which applies a pressure to the liquid in the pressure chamber, including:

providing a piezoelectric layer having a first active portion corresponding to a central portion of the pressure chamber, and a second active portion corresponding to a portion at an outer periphery of the central portion of the pressure chamber; and arranging an individual electrode to which a first electric potential and a second electric potential different from the first electric potential are applied selectively, a first constant electric potential electrode to which the first electric potential is applied, and a second constant electric potential electrode to which the second electric potential is applied, such that the first active portion is sandwiched between the individual electrode and the first constant electric potential electrode, and that the second active portion is sandwiched between the individual electrode and the second constant electric potential electrode; and joining the channel unit and the piezoelectric actuator by positioning the first constant electric potential electrode of the piezoelectric actuator to be overlapped with the central portion of the pressure chamber of the channel unit.

According to the method of manufacturing the liquid transporting apparatus of the present invention, at the joining step, since the first active portion overlaps the central portion of the pressure chamber by arranging the first constant electric potential electrode to overlap with the central portion of the pressure chamber in a plan view, it is possible to apply a pressure to the liquid in the pressure chamber, without an amount of displacement of a piezoelectric layer due to a deformation generated in the first portion, becoming small.

A pitch of a plurality of first constant electric potential electrodes and a pitch of a plurality of pressure chambers in the row direction may be measured, and a combination of the piezoelectric actuator and the channel unit for which the pitch of the first constant electric potential electrodes and the pitch of the pressure chambers are within a tolerance may be selected. In this case, it is possible to prevent degradation of jetting characteristics which is caused due to a variation in the pitch of the plurality of electrodes which are formed corresponding to the plurality of pressure chambers respectively.

DETAILED DESCRIPTION OF THE PREFERRED EMBODIMENTS

First Embodiment

Figure 1:
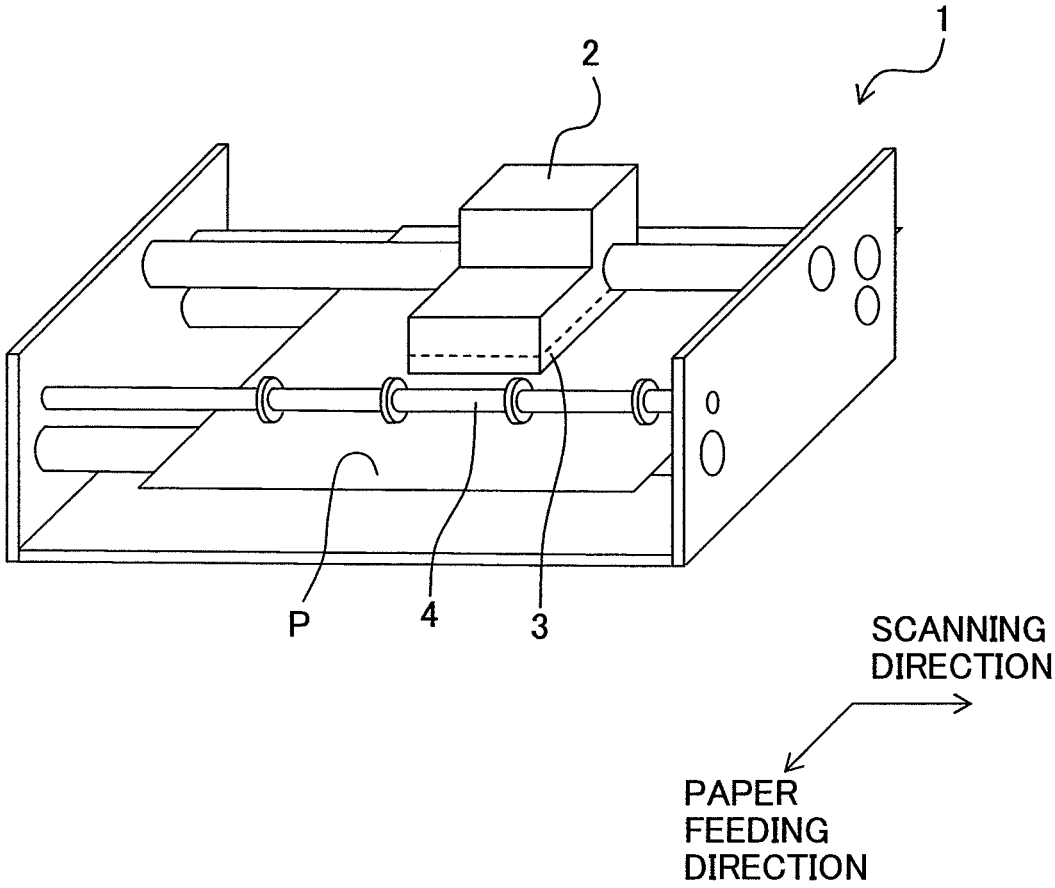
FIG. 1 is a schematic structural view of a printer according to an embodiment.
Figure 2:
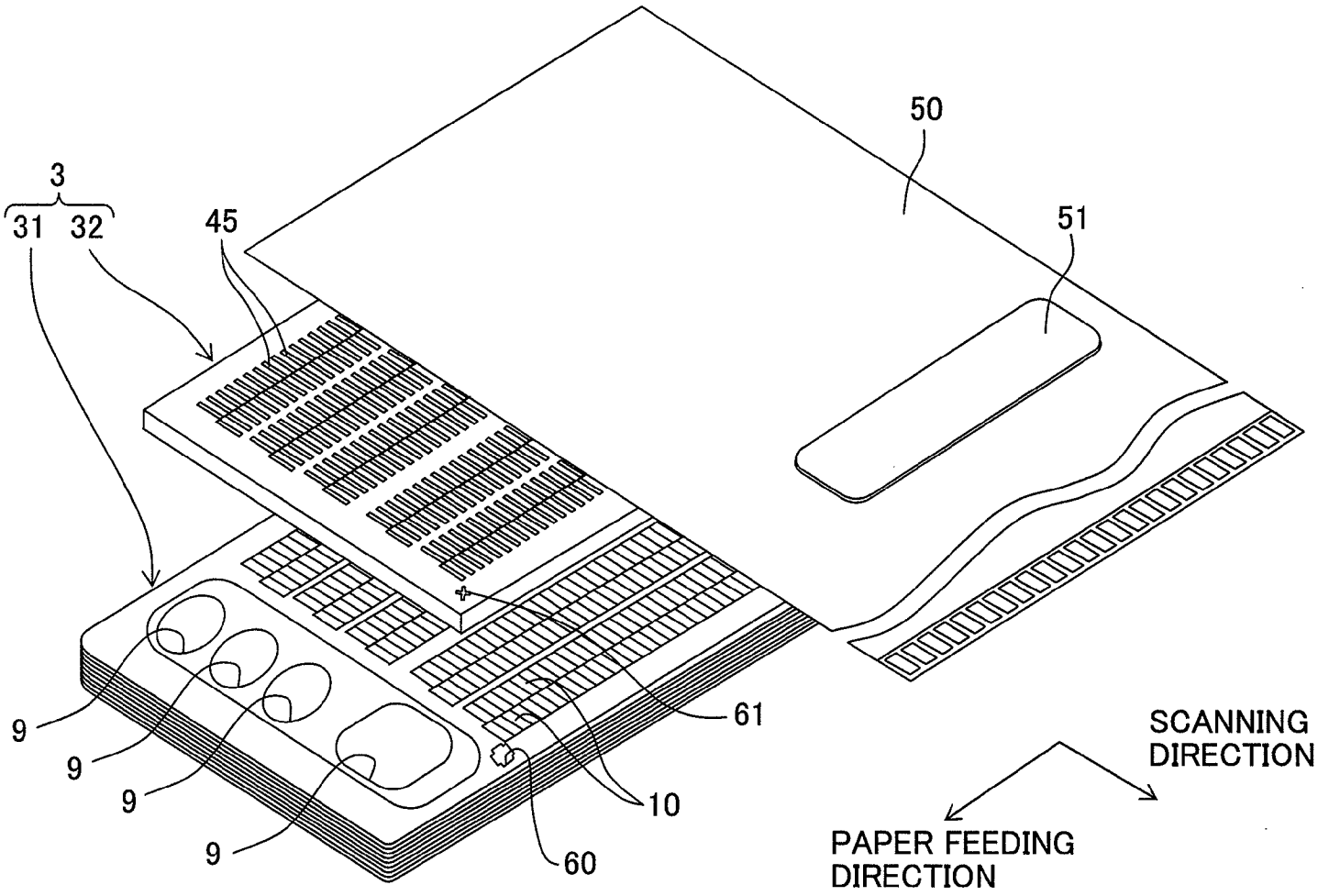
FIG. 2 is a perspective view of an ink jet head.

An exemplary embodiment (a first embodiment) of the present teachings will be described below. As shown in FIG. 1, a printer 1 includes a carriage 2, an ink-jet head 3, and a transporting roller 4.

The carriage 2 reciprocates in a scanning direction (left-right direction in FIG. 1). The ink jet head 3 is installed on a lower surface of the carriage 2, and jets an ink from nozzles 15 (refer to FIG. 3) formed in a lower surface of the ink-jet head 3. The transporting roller 4 transports a recording paper P in a paper feeding direction (frontward direction in FIG. 1). Moreover, in the printer 1, the ink is jetted onto the recording paper P via the nozzles 15 of the ink-jet head 3 which reciprocates in the scanning direction together with the carriage 2 to perform printing on the recording paper. Moreover, after printing on the recording paper, the recording paper P is discharged in the paper feeding direction by the transporting roller 4.

Figure 3:
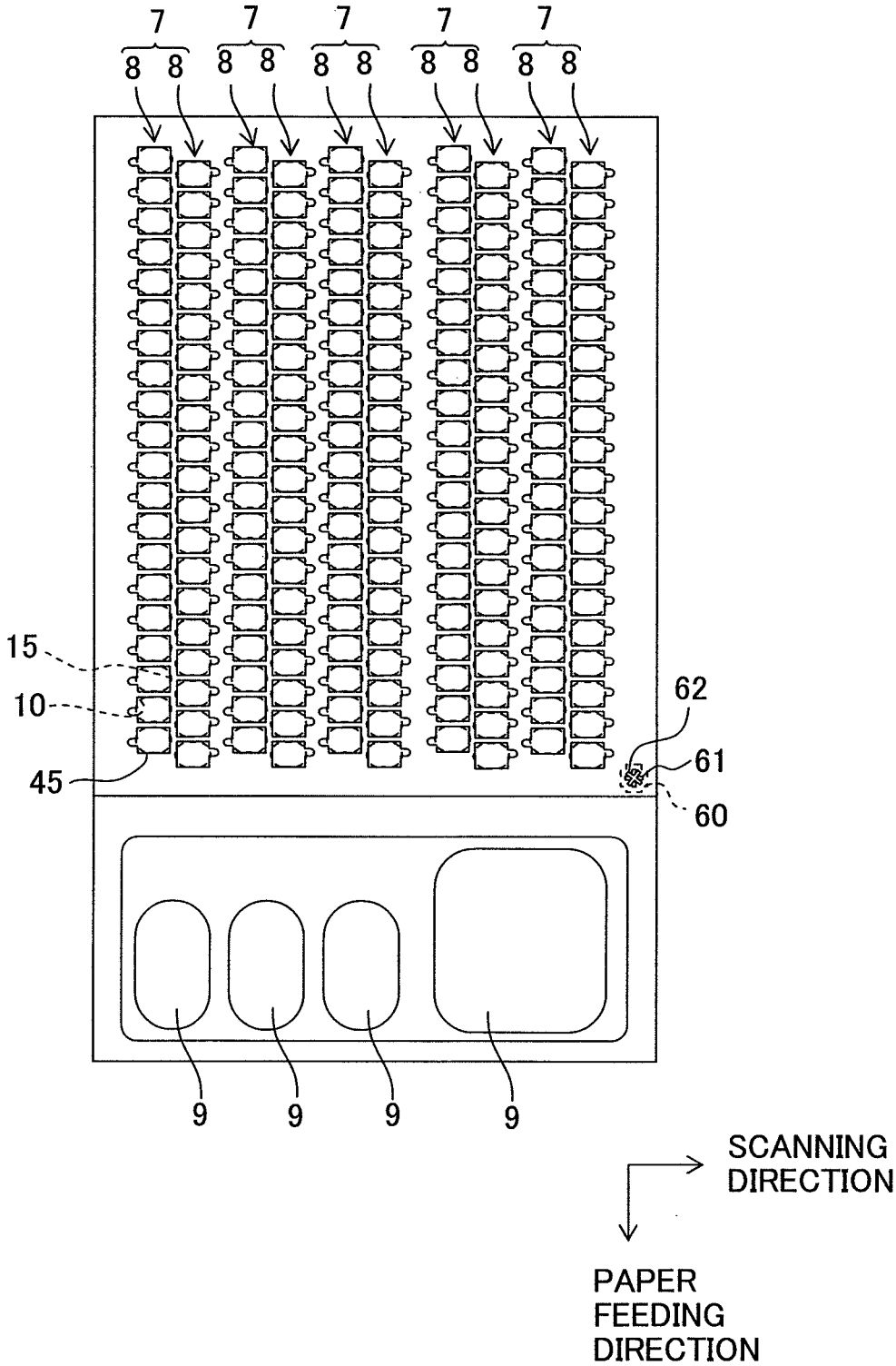
FIG. 3 is a plan view of the ink jet head.
Figure 4A:
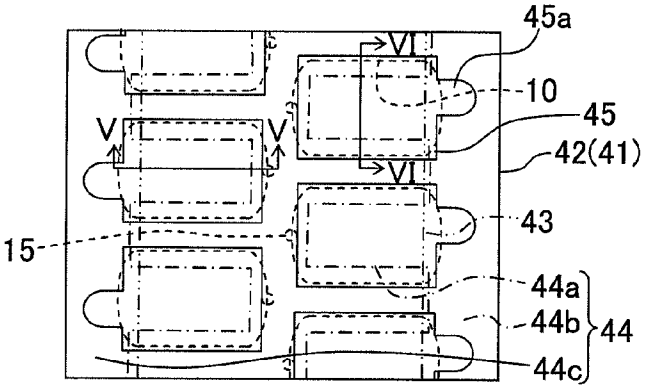
FIG. 4A is a partially enlarged view of FIG. 3.
Figure 4B:
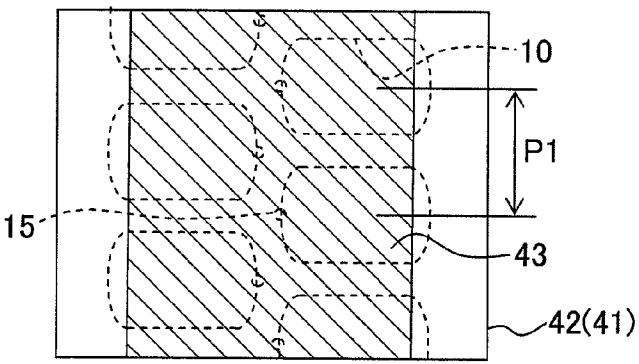
FIG. 4B is a horizontal cross-sectional view of FIG. 4A showing a vibration plate.
Figure 4C:
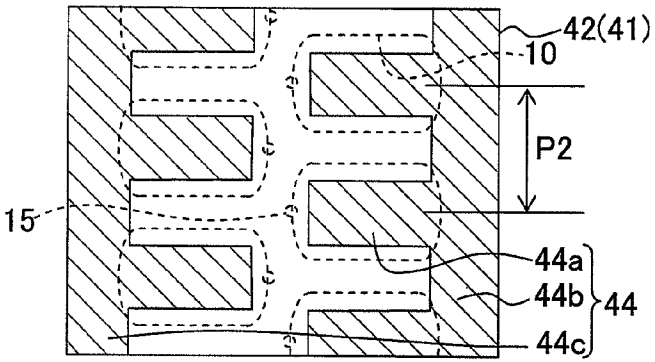
FIG. 4C is a horizontal cross-sectional view of FIG. 4A showing a lower piezoelectric layer.
Figure 4D:
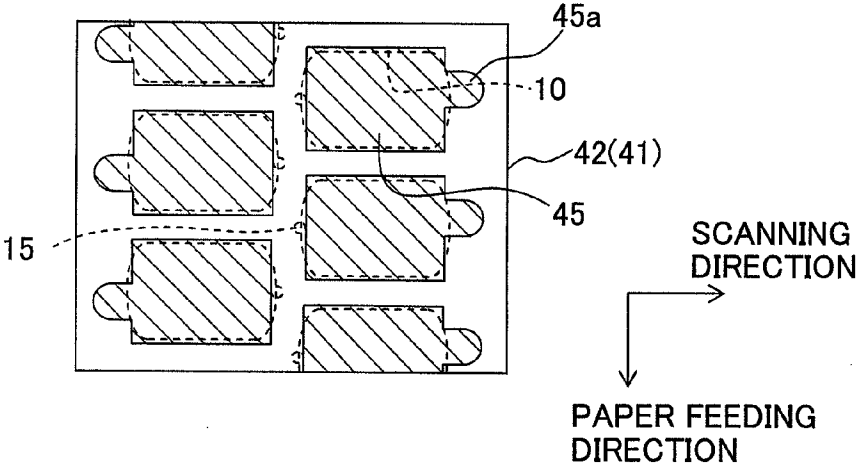
FIG. 4D is a horizontal cross-sectional view of FIG. 4A showing an upper surface of an upper piezoelectric layer.
Figure 5:
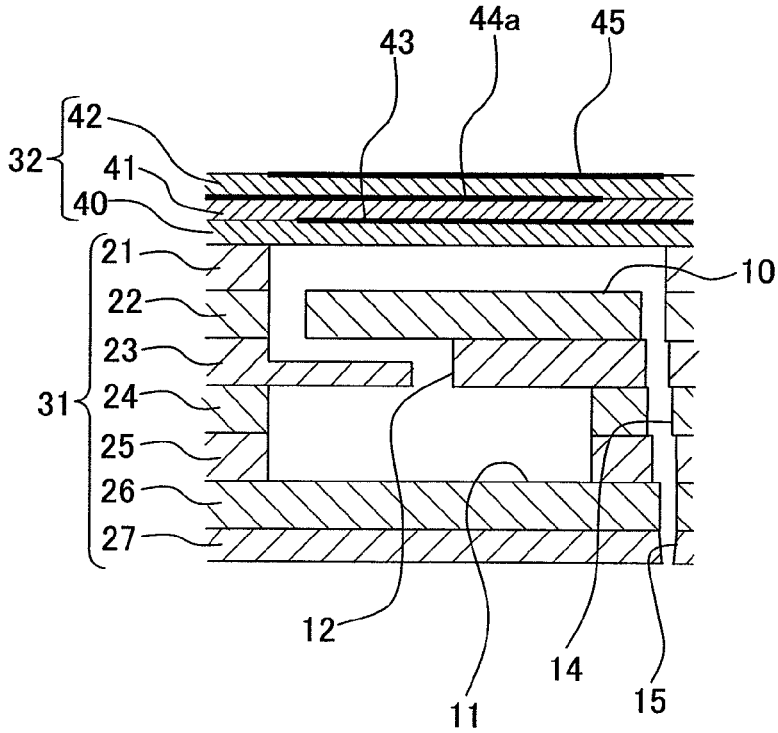
FIG. 5 is a cross-sectional view taken along a V-V line in FIG. 4A.
Figure 6:
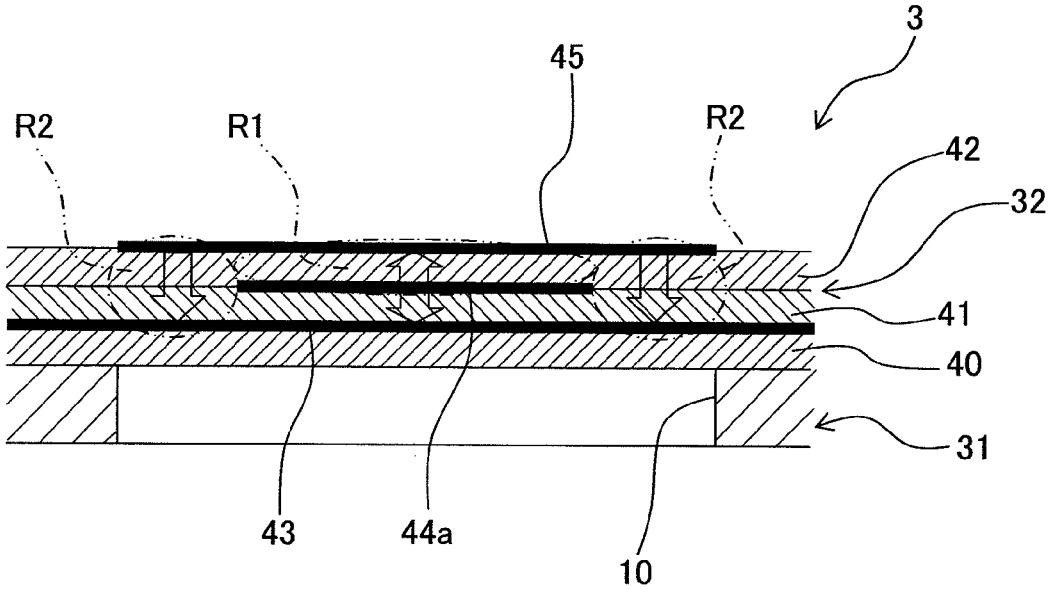
FIG. 6 is a cross-sectional view taken along a VI-VI line in FIG. 4A.

Next, the ink-jet head 3 will be described below. In FIGS. 3 and 4A to 4D, ink channels excluding pressure chambers 10 and the nozzles 15 of a channel unit 31 which will be described later are omitted. In FIG. 3, a lower electrode 43 and an intermediate electrode 44 of a piezoelectric actuator 32 are omitted. Moreover, in FIG. 4A and FIG. 4B, the lower electrode 43 and the intermediate electrode 44 which are to be shown by dotted lines are shown by an alternate long and short dash lines and an alternate long and two short dashes lines respectively. Furthermore, in FIG. 4B to 4D, the lower electrode 43, the intermediate electrode 44, and an upper electrode 45 which will be described later are hatched. Moreover, in FIG. 6, a portion of the channel unit 31 lower than the pressure chamber 10 is omitted.

As shown in diagrams from FIG. 2 to FIG. 6, the ink-jet head 3 has the channel unit 31 and the piezoelectric actuator 32. The channel unit 31 is formed by a plurality of stacked plates 21 to 27. A plurality of ink channels is formed in the channel unit 31, the ink channels including a manifold channel 11 through which ink is supplied from an ink supply port 9, and a plurality of individual channels each extending from an outlet of the manifold channel 11 up to one of the pressure chambers 10 via an aperture channel 12, and further extending from the one of the pressure chambers 10 up to one of the nozzles 15 via a descender channel 14. Moreover, as it will be described later, when a pressure is applied to the ink in one of the pressure chambers 10 by the piezoelectric actuator 32, the ink is jetted from a nozzle 15 communicating with the one of the pressure chambers 10.

The plurality of pressure chambers 10 have a substantially elliptical shape with the scanning direction (left-right direction in FIG. 3) as a longitudinal direction of the elliptical shape in a plan view, and are arranged in a row along the paper feeding direction (vertical direction in FIG. 3) forming a pressure chamber row 8. Two such pressure chamber rows 8 are arranged to form a pressure chamber group 7. Furthermore, five such pressure chamber groups 7 are arranged in the scanning direction. Here, the pressure chambers 10 forming the two pressure chamber rows 8 in one pressure chamber group 7 are arranged to be misaligned mutually. Moreover, the plurality of nozzles 15 is also arranged similarly as the plurality of pressure chambers 10. In other words, the pressure chambers 10 and the nozzles 15 are arranged in a staggered form.

A black ink is jetted from the nozzles 15 corresponding to the pressure chambers 10 included in two pressure chamber groups 7 arranged at a right side in FIG. 3, and inks of yellow, cyan, and magenta color are jetted from the nozzles 15 corresponding to the pressure chambers 10 included in the rest of three pressure chamber groups 7. Pressure chamber groups 7 for yellow, cyan, and magenta inks are arranged in this order from the right side. A structure of other portions of the ink channels being similar to a conventional structure, the description in detail thereof is omitted here.

A hole 60 (a second mark) which is cut through a direction in which the plates 21 to 27 are stacked is formed in the channel unit 31, at a position away from a predetermined distance from a center of a certain pressure chamber 10, in a direction parallel to a surface in which the pressure chambers 10 are formed. The hole 60 is formed at a position overlapping with an upper electrode mark 61 and an intermediate electrode mark 62 which will be described later, in a plan view, and not overlapping with electrodes 43, 44, and 45 which will be described later, in a plan view.

The piezoelectric actuator 32 includes a vibration plate 40 (a second piezoelectric sheet) and a lower piezoelectric layer 41 (a first piezoelectric sheet), an upper piezoelectric layer 42 (a third piezoelectric sheet), a lower electrode 43 (a second constant electric potential electrode), an intermediate electrode 44 (a first constant electric potential electrode), upper electrodes 45 (individual electrodes), the intermediate electrode mark 62 (the first mark), and the upper electrode mark 61. The vibration plate 40 is made of a piezoelectric material having lead zirconate titanate as a principal component, which is a mixed crystal (mixed crystalline compound) of lead titanate and lead zirconate, and is arranged on an upper surface of the channel unit 31, to over the plurality of pressure chambers 10. Moreover, a thickness of the vibration plate 40 is about 20 μm. The vibration plate 40 is not necessarily required to be made of a piezoelectric material.

The lower piezoelectric layer 41 and the upper piezoelectric layer 42 are made of a piezoelectric material same as of the vibration plate 40, and are arranged on the vibration plate 40 upon stacking mutually. Moreover, a thickness of each of the lower piezoelectric layer 41 and the upper piezoelectric layer 42 is about 20 μm.

The lower electrode 43 is formed on an upper surface of the vibration plate 40 and arranged between the vibration plate 40 and the lower piezoelectric layer 41. Further, the lower electrode 43 is extended in the paper feeding direction along the two pressure chamber rows 8 forming each pressure chamber group 7, corresponding to each pressure chamber group 7, and faces the plurality of pressure chambers 10 which is included in the two pressure chamber rows 8. Moreover, although it is not shown in the diagram, portions of the lower electrode 43, which are extended in the paper feeding direction, are connected mutually. The lower electrode 43 is connected to a driver IC 51 via a flexible printed circuit (FPC) 50 arranged at an upper side of the piezoelectric actuator 32, and is kept at a ground electric potential (a second electric potential) all the time by the driver IC 51.

The intermediate electrode 44 is formed on an upper surface of the lower piezoelectric layer 41 and arranged between the lower piezoelectric layer 41 and the upper piezoelectric layer 42. The intermediate electrode 44 has a plurality of facing portions 44*a*, and connecting portions 44*b* and 44*c*, for each of the pressure chamber groups 7. The plurality of facing portions 44*a* have a substantially rectangular shape in which a length of the facing portions 44*a* in the paper feeding direction in a plan view is shorter than that of the pressure chamber 10. Further, the facing portions 44*a* are arranged to face a central portion of the plurality of pressure chambers 10, respectively.

As shown in FIG. 4, the connecting portion 44*b* is extended in the paper feeding direction, and the connecting portion 44*b* connects right ends of the plurality of facing portions 44*a* corresponding to the plurality of pressure chambers 10 which form the pressure chamber row 8 arranged on the right side. The connecting portion 44*c* is extended in the paper feeding direction, and connects left ends of the plurality of facing portions 44*a* corresponding to the plurality of pressure chambers 10 which form the pressure chamber row 8 arranged on the left side. Moreover, the intermediate electrode 44 is connected to the driver IC 51 via the FPC 50, and is kept all the time, by the driver IC 51, at a predetermined electric potential (such as about 20 V: a first electric potential) which is different from the ground electric potential.

The plurality of upper electrodes 45 is formed on an upper surface (a surface on an opposite side of the lower piezoelectric layer 41) of the upper piezoelectric layer 42, and is arranged to face almost an entire area of the plurality of pressure chambers 10. The upper electrode 45 has a substantially rectangular shape in a plan view, and a length of the upper electrode 45 in the paper feeding direction is longer than that of the facing portion 44*a* of the intermediate electrode 44. Moreover, a portion of an end of the upper electrode 45, on an opposite side of the nozzle 15 in the scanning direction, is extended up to a portion not facing the pressure chamber 10, and this extended portion is a connecting terminal 45*a* which is to be connected to the FPC 50. Moreover, the upper electrode 45 is connected to the driver IC 51 via the FPC 50, and an electric potential of the upper electrode 45 is selectively switched to the ground electric potential and a predetermined electric potential (such as 20 V).

Since the lower electrode 43, the intermediate electrode 44, and the upper electrode 45 are arranged in such manner, the upper electrode 45 and the intermediate electrode 44 face at a portion, of the upper piezoelectric layer 42, facing the central portion of the pressure chamber 10. Moreover, since an area of the upper piezoelectric layer 42 sandwiched between the upper electrode 45 and the intermediate electrode 44 is polarized in an upward direction (a direction from the intermediate electrode 44 toward the upper electrode 45), this area is a first active portion R1.

Furthermore, the upper electrode 45 and the lower electrode 43 face at an area, of the upper piezoelectric layer 42 and the lower piezoelectric layer 41, facing the pressure chamber 10, the area not facing the intermediate electrode 44 and being located at an outer periphery of a portion facing the intermediate electrode 44. Moreover, since the area of the upper piezoelectric layer 42 and the lower piezoelectric layer 41 is polarized in a downward direction (a direction from the upper electrode 45 toward the lower electrode 43), this area is a second active portion R2.

A portion of the lower piezoelectric layer 41, sandwiched between the intermediate electrode 44 and the lower electrode 43 is polarized in the downward direction (a direction from the intermediate electrode 44 toward the lower electrode 43).

The upper electrode mark 61 is made of a same material of the upper electrode 45 and is formed on an upper surface of the upper piezoelectric layer 42. The upper electrode mark 61 is a "X"-shaped mark for positioning which is not connected electrically to any electrode. The upper electrode mark 61 is formed at a position a predetermined distance away from a center of the upper electrode 45 corresponding to a certain pressure chamber which is located at a position the predetermined distance away from the hole 60 formed in the channel unit 31. The upper electrode mark 61 is formed so as to overlap, in a plan view, with the hole 60 in the channel unit 31 and the intermediate electrode mark 62 which will be described later.

The intermediate electrode mark 62 is made of a material of the intermediate electrode 44, and is formed on an upper surface of the lower piezoelectric layer 41. The intermediate electrode mark 62 is a "+"-shaped mark for positioning which is not connected electrically to any electrode. The intermediate electrode mark 62 is formed at a position the predetermined distance away from a center of the intermediate electrode 44 corresponding to the certain pressure chamber which is located at the position the predetermined distance away from the hole 60 formed in the channel unit 31. The upper electrode mark 61 and the intermediate electrode mark 62 are formed at positions not overlapping the electrodes 43 to 45 in a plan view.

When the channel unit 31 and the piezoelectric actuator 32 are positioned such that the hole 62 in the channel unit 31 and the intermediate electrode mark 62 of the piezoelectric actuator 32 overlap in a plan view, each of the facing portions 44*a* of the intermediate electrode 44 overlaps with the central portion of one of the pressure chambers 10. In other words, each of the first active portions R1 is arranged to overlap with the central portion of one of the pressure chamber 10 in a plan view.

Here, an operation of the piezoelectric actuator 32 will be described below. Firstly, in a standby state before the piezoelectric actuator 32 carries out an operation of jetting, as it has been described before, the lower electrode 43 and the intermediate electrode 44 are kept all the time at the ground electric potential and the predetermined electric potential (such as 20 V) respectively, and an electric potential of the upper electrode 45 is kept at the ground electric potential in advance. In this state, an electric potential of the upper electrode 45 is lower than that of the intermediate electrode 44, and is same as that of the lower electrode 43.

Accordingly, an electric potential difference is developed between the upper electrode 45 and the intermediate electrode 44, and an electric field in an upward direction which is same as the polarization direction thereof is generated in the first active portion R1, and the active portion R1 contracts in a horizontal direction orthogonal to the electric field. Accordingly, a so-called unimorph deformation is generated, and a portion, of the upper piezoelectric layer 42, the lower piezoelectric layer 41, and the vibration plate 40, facing the pressure chamber 10 is deformed to form a projection toward the pressure chamber 10. In this state, a volume of the pressure chamber 10 has become smaller as compared to a case in which the upper piezoelectric layer 42, the lower piezoelectric layer 41, and the vibration plate 40 are not deformed.

Next, at the time of driving the piezoelectric actuator 32 to jet the ink, after the electric potential of the upper electrode 45 is once switched to the predetermined electric potential, the electric potential of the upper electrode 45 returns to the ground electric potential. When the electric potential of the upper electrode 45 is switched to the predetermined electric potential, the electric potential of the upper electrode 45 is same as that of the intermediate electrode 44, and is higher than that of the lower electrode 43. Accordingly, the contraction of the first active portion R1 returns to an original state. At the same time, an electric potential difference is developed between the upper electrode 45 and the lower electrode 43, and an electric field in a downward direction same as the direction of polarization thereof is generated in the second active portion R2, and the active portion R2 contracts in the horizontal direction. Accordingly, the upper piezoelectric layer 42, the lower piezoelectric layer 41, and the vibration plate 40 as a whole are deformed to form a projection toward the opposite side of the pressure chamber 10, and the volume of the pressure chamber 10 increases.

As the electric potential of the upper electrode 45 is returned to the ground electric potential, similarly as it has been described above, the portion of the upper piezoelectric layer 42, the lower piezoelectric layer 41, an the vibration plate 40 facing the pressure chamber 10 is deformed as a whole to form a projection toward the pressure chamber 10, and the volume of the pressure chamber 10 decreases. Accordingly, a pressure of the ink in the pressure chamber 10 rises up (a pressure is applied to the ink inside the pressure chamber 10), and the ink is jetted from the nozzle 15 communicating with the pressure chamber 10.

Moreover, in a case of driving the piezoelectric actuator 32 as mentioned above, when the electric potential of the upper electrode 45 is switched from the ground electric potential to a predetermined electric potential, the first active portion R1 is returned to a state before contraction, in other words, is elongated from a contracted state. At the same time, since the second active portion R2 contracts, the elongation of the first active portion R1 is partly absorbed by the contraction of the second active portion R2. On the other hand, when the electric potential of the upper electrode 45 is returned to the ground electric potential from the predetermined electric potential, the first active portion R1 contracts and the second active portion R2 is returned a state before contraction, in other words, is elongated up to a state before contraction. Therefore, the contraction of the first active portion R1 is partly absorbed by the elongation of the second active portion R2.

Accordingly, a so-called cross-talk is suppressed. The cross-talk is a phenomenon in which the deformation of the portion of the lower piezoelectric layer 41 and the upper piezoelectric layer 42 facing the pressure chamber 10 is transmitted to a portion facing the other pressure chamber 10, and jetting characteristics of ink from the nozzle 15 communicating with the other pressure chamber 10 fluctuates.

As it has been mentioned above, while in a standby state, and while the piezoelectric actuator 32 is driven, an electric potential difference is always developed in the portion, of the lower piezoelectric layer 41, sandwiched between the intermediate electrode 44 and the lower electrode 43, and an electric field in a direction same as the polarization direction thereof is generated in this portion of the lower piezoelectric layer 41. Accordingly, this portion of the lower piezoelectric layer 41 is always in a state of being contracted in a direction perpendicular to the direction of the electric field.

Here, when the facing portion 44*a* of the intermediate electrode 44 of the piezoelectric actuator 32 is arranged to be shifted (misaligned) from the central portion of the pressure chamber 10 of the channel unit 31, unlike a case in which the upper electrode 45 is arranged to be shifted, the first active portion R1 is shifted from the central portion of the pressure chamber 10. As the first active portion R1 is shifted, an amount of displacement of the portion of the upper piezoelectric layer 42, the lower piezoelectric layer 41, and the vibration plate 40, facing the pressure chamber 10 due to the deformation developed in the first active portion R1 becomes small. Accordingly, an amount of change in the volume of the pressure chamber 10 becomes small, and it is not possible to apply a predetermined pressure to the ink inside the pressure chamber 10. Therefore, to make it possible to apply the predetermined pressure to the ink in the pressure chamber 10, the facing portion 44*a* of the intermediate electrode 44 of the piezoelectric actuator 32 is to be arranged to overlap with the central portion of the pressure chamber 10 of the channel unit 31.

Next, a method of manufacturing the ink-jet head 3 will be described below. In the method of manufacturing the ink-jet head 3, a step of producing the channel unit 31, a step of producing the piezoelectric actuator 32, and a step of joining the channel unit 31 and the piezoelectric actuator 32 produced separately in the these two steps, are carried out.

Figure 7A:
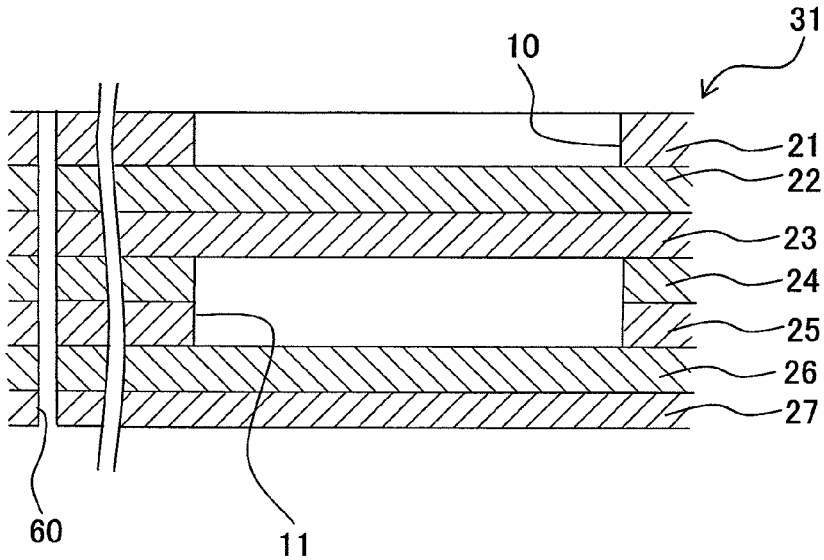
FIG. 7A shows a step of producing a channel unit.

Firstly, through holes which are cut through in the thickness direction are formed, in the seven plates 21 to 27 which are to be the channel unit 31, to define ink channels such as the pressure chambers 10, the manifold channels 11, and the nozzles 15. Moreover, other through holes are formed in each of the seven plates 21 to 27, and when the channel unit 31 is formed, these through holes are connected with each other to form the hole 60 which is cut through the thickness direction. These holes as described above are formed by etching or laser machining. Next, as shown in FIG. 7A, by joining the seven plates 21 to 27 by an adhesive while heating and pressing upon stacking, the channel unit 31 is produced (channel unit producing step). When the seven plates 21 to 27 are formed of a metallic material, the seven plates 21 to 27 may be joined by a metal diffusion joining. The hole 60 may be formed after the seven plates 21 to 27 are stacked.

Moreover, separately from the channel unit producing step, the upper electrode 45, the intermediate electrode 44, and the lower electrode 43 are formed on surfaces of three green sheets of piezoelectric ceramics having the same outer shape, which are formed upon calculating in advance an amount of contraction due to baking. At this time, the "X"-shaped upper electrode mark 61 is formed on the green sheet on which the upper electrode 45 is formed, at a position to be overlapped with the hole 60 formed in the channel unit 31 at the time of the joining step which will be described later. The position, at which the upper electrode mark 61 is formed, is located a predetermined distance away from the abovementioned upper electrode 45, and the upper electrode mark 61 is formed by screen printing together with the upper electrode 45. Moreover, the "+"-shaped intermediate electrode mark 62 is formed on the green sheet on which the intermediate electrode 44 is formed, at a position to be overlapped with the hole 60 formed in the channel unit 31 at the time of the joining step which will be described later. The position, at which the intermediate electrode mark 62 is formed, is located a predetermined distance away from the abovementioned intermediate electrode 44, and the intermediate electrode mark 62 is formed by screen printing together with the intermediate electrode 44.

Figure 7B:
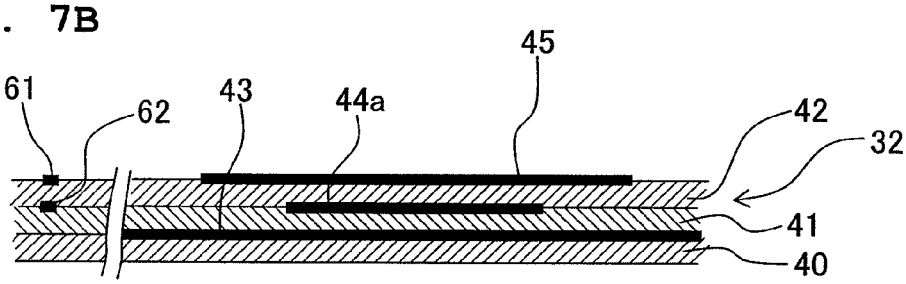
FIG. 7B shows a step of producing a piezoelectric actuator.

Next, as shown in FIG. 7B, the three green sheets are stacked in order of the green sheet on which the lower electrode 43 is formed, the green sheet on which the intermediate electrode 44 is formed, and the green sheet on which the upper electrode 45 is formed, from below. Then, the three green sheets are stacked such that the outer shape thereof are coincided. Further, the green sheets are stacked such that the upper electrode mark 61 and the intermediate electrode mark 62 overlap in a plan view. Thereafter, the stacked body of green sheets is baked at a predetermined temperature, and the piezoelectric actuator 32 in which the vibration plate 40, the lower piezoelectric layer 41, and the upper piezoelectric layer 42 are stacked in this order is produced (piezoelectric actuator producing step). Here, sometimes, in the piezoelectric actuator 32, the upper electrode mark 61 and the intermediate electrode mark 62 do not overlap in a plan view, due to some reasons such as a difference in an amount of contraction of the plurality of green sheets at the time of baking, a misalignment of positions of the plurality of green sheets at the time of stacking, or a misalignment of the printing of the electrodes.

Figure 7C:
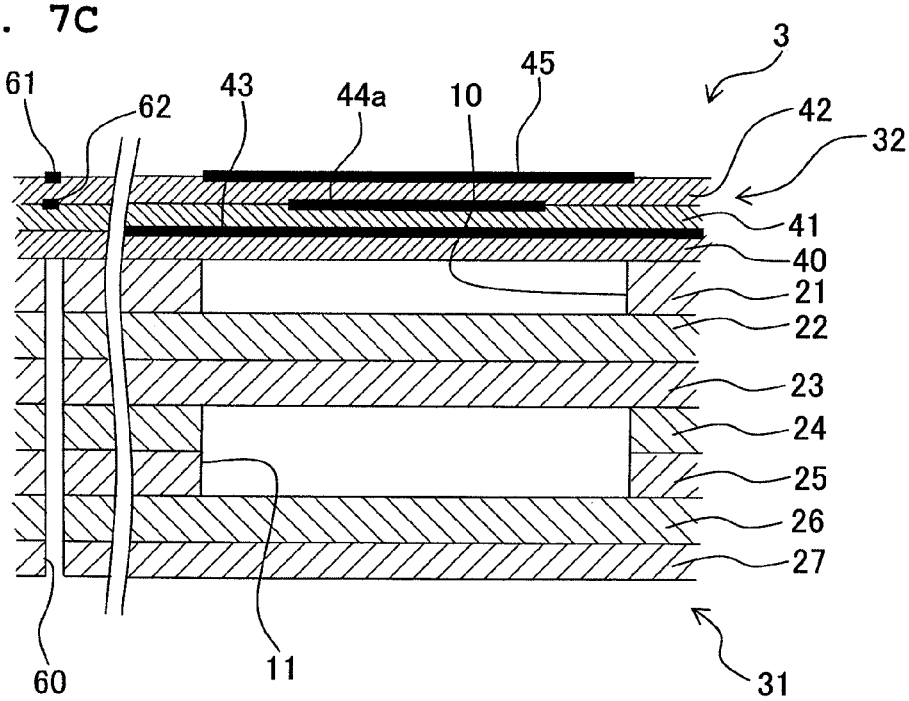
FIG. 7C shows a step of joining the channel unit and the piezoelectric actuator.
Figure 8A:
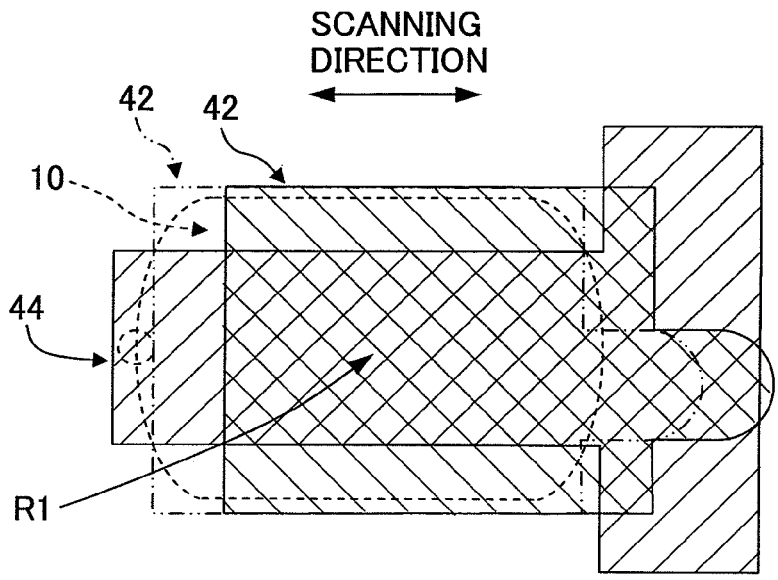
FIG. 8A is a partially enlarged plan view showing a state in which the upper electrode is shifted in a scanning direction from an appropriate position.
Figure 8B:
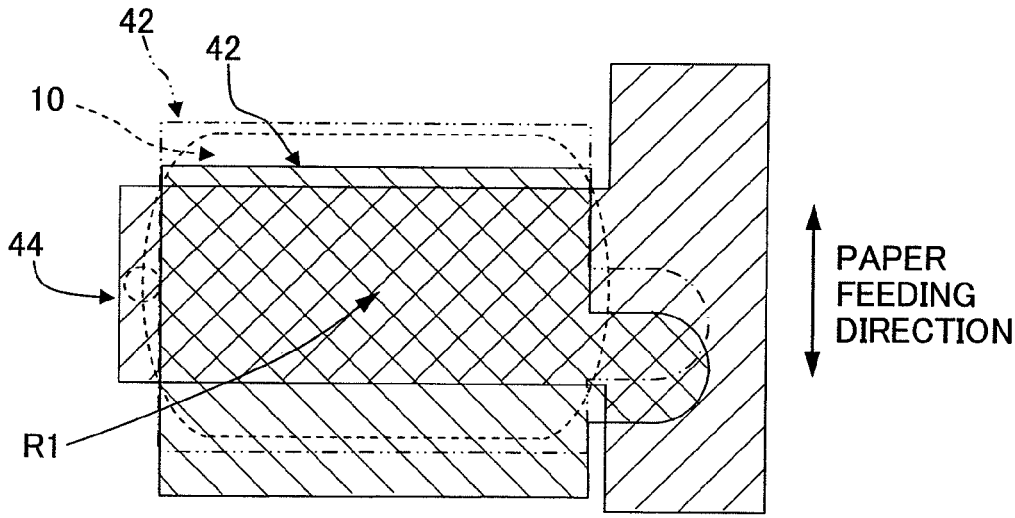
FIG. 8B is a partially enlarged plan view showing a state in which the upper electrode is shifted in a paper feeding direction from the appropriate position.

Next, as shown in FIG. 7C, while irradiating light from below to the hole 60 in the channel unit 31 produced in the channel unit producing step, the channel unit 31 and the piezoelectric actuator 32 are aligned and joined (joining step) such that, the hole 60 in the channel unit 31 and the intermediate electrode mark 62 formed on the lower piezoelectric layer 41 of the piezoelectric actuator 32 overlap in a plan view. At this time, since the piezoelectric actuator 32 is formed by stacking thin ceramics layer, it is possible to see through the intermediate electrode mark 62 when light is irradiated.

Accordingly, it is possible to overlap accurately, the central portion of the pressure chamber 10 of the channel unit 31 and the facing portion 44*a* of the intermediate electrode 44 of the piezoelectric actuator 32 in a plan view. In this manner, it is possible to manufacture the ink-jet head 3 in which it is possible to apply a predetermined pressure to the ink in the pressure chamber 10 by displacing the portion, of the upper piezoelectric layer 42, the lower piezoelectric layer 41, and the vibration plate 40, facing the pressure chamber 10.

At this time, the hole 60 of the channel unit 31 is through in the stacking direction of the plates. Therefore, it can be seen easily when light is irradiated from under the channel unit 31, and it is possible to carry out the alignment of the channel unit 31 and the piezoelectric actuator 32 easily.

The intermediate electrodes 44 are arranged inside the piezoelectric actuator 32, and these intermediate electrodes 44 cannot be seen for being hidden behind the upper electrodes 45. Therefore, it is difficult to align the intermediate electrodes 44 directly, to overlap the central portion of the pressure chambers 10. Whereas, according to the method of manufacturing the ink-jet head of the first embodiment, the intermediate electrode mark 62 which is located the predetermined distance away from a center of a certain intermediate electrode 44 is arranged to be overlapped with the hole 60 which is located the predetermined distance away from a center of a certain pressure chamber 10. Therefore, it is possible to align the intermediate electrodes 44 easily to overlap with the central portion of the pressure chambers 10.

As it has been mentioned above, in a case of forming the piezoelectric actuator 32 in which relative positions of the upper electrodes 45 and the intermediate electrodes 44 are shifted, when the intermediate electrodes 44 of such piezoelectric actuator 32 are arranged to be overlapped with the central portions of the pressure chambers 10, the central portions of the upper electrodes 45 of the piezoelectric actuator 32 are shifted from the pressure chambers 10 in a plan view. At this time, the second active portion R2 cannot be arranged evenly on both sides in the paper feeding direction sandwiching the first active portion R1, and it is not possible to apply the predetermined pressure to the ink in the pressure chamber 10.

Therefore, even though the intermediate electrodes 44 are not arranged to be overlapped with the central portion of the upper electrode 45, to make it possible to apply the predetermined pressure to the ink in the pressure chambers 10, the piezoelectric actuator 32 is ranked into a plurality of ranks based on a degree of a position shift of the upper electrode mark 61 and the intermediate electrode mark 62 of the piezoelectric actuator 32 produced in the piezoelectric actuator producing step. Furthermore, higher the rank of position shift for the piezoelectric actuator 32, higher is a voltage to be applied to the upper electrode 45 from the driver IC 51. Then, it is possible to increase the amount of displacement of the portion of the upper piezoelectric layer 42, the lower piezoelectric layer 41, and the vibration plate 40, facing the pressure chamber 10. Therefore, it is possible to produce the piezoelectric actuator 32 which is capable of applying the predetermined pressure to the ink in the pressure chamber 10 even though the central portions of the upper electrodes 45 are arranged to be shifted from the central portions of the pressure chambers 10.

Next, modified embodiments in which various modifications are made in the first embodiment will be described below. However, same reference numerals are assigned to components having a similar structure as in the first embodiment, and description of such components is omitted.

In the first embodiment, the upper electrode mark 61 and the intermediate electrode mark 62 are formed on the piezoelectric actuator 32, and the hole 60 is formed in the channel unit 31. However, the upper electrode mark 61 may not be formed on the piezoelectric actuator 32, and at least the intermediate electrode mark 62 may be formed. At this time, for instance, the intermediate electrodes 44 may be arranged to be overlapped with the central portions of the pressure chambers 10 by aligning upon detecting a position of an outer edge of the channel unit 31 relative to the intermediate electrodes 62.

Moreover, in the first embodiment, the alignment of the intermediate electrode mark 62 formed on the piezoelectric actuator 32 and the hole 60 formed in the channel unit 31 has been carried out. However, the intermediate electrode 62 and the hole 60 may not be formed necessarily, and the intermediate electrodes 44 may be aligned directly such that the intermediate electrodes 44 which can be seen through from the upper electrodes 45 overlap with the central portions of the pressure chambers 10, by irradiating light toward an upper surface of the piezoelectric actuator 32. Accordingly, since the electrodes are thin, the intermediate electrodes 44 can be seen through when light is irradiated. Therefore, it is possible to align the intermediate electrodes 44 directly, and an accuracy of alignment is improved.

Furthermore, the upper electrode mark 61 and the intermediate electrode mark 62 are not restricted to marks made by an electroconductive piezoelectric material formed by screen printing together with the electrode on the piezoelectric layer, and may be marks made by a notch formed on a surface of the piezoelectric layer, or marks made by colored ink applied to the surface of the piezoelectric layer.

Moreover, the mark formed in the channel unit 31 may not be the hole 60, and may be a mark made by a notch formed on a surface of the plate 21, or may be a mark made by a colored ink applied to the surface of the plate 21.

Moreover, in the above description, the upper electrode mark 61, the intermediate electrode mark 62, and the hole 60 are formed at one location respectively. However, the upper electrode mark 61, the intermediate electrode mark 62, and the hole 60 may be formed at a plurality of locations respectively. Accordingly, it is possible to align the piezoelectric actuator 32 and the channel unit 31 by calculating a barycentric position of each of the intermediate electrodes 62 and the hole 60 formed in plurality, and to minimize a manufacturing error of the plurality of intermediate electrodes 44 and the pressure chambers 10 in the manufacturing steps of the piezoelectric actuator 32 and the channel unit 31. Even for the upper electrode mark 61, it is possible to set a rank of the piezoelectric actuator 32 upon taking into consideration a manufacturing error of the plurality of upper electrodes 45 in the manufacturing step similarly.

Moreover, when a positional relationship of the intermediate electrode mark 62 and the intermediate electrode 44 is known, the alignment of the intermediate electrode mark 62 of the piezoelectric actuator 32 and the hole 60 of the channel unit 31 may not be carried out. In this case, positions of the intermediate electrodes 44 may be calculated from a position of the intermediate electrode mark 62, and based on the positions of the intermediate electrodes 44, the alignment may be carried out such that the intermediate electrodes 44 overlap with the central portions of the pressure chambers 10. In other words, even though it is difficult to see the intermediate electrodes 44 directly, since it is possible to calculate the positions of the intermediate electrodes 44 from the intermediate electrode mark 62, it is possible to align the intermediate electrodes 44 easily with the central portions of the pressure chambers 10 by aligning based on the intermediate electrode mark 62.

Furthermore, in the first embodiment, the lower electrodes 43 to which the ground electric potential is applied all the time, the intermediate electrodes 44 to which the predetermined electric potential is applied all the time, and the upper electrodes 45 to which the ground electric potential and the predetermined electric potential are selectively applied, are arranged in this order from a side of the channel unit 31. However, the positions of the lower electrodes 43 and the upper electrodes 45 may be reverse. Moreover, the lower electrodes 43 are formed to be extended continuously in the paper feeding direction. However, the lower electrodes 43 may not be formed in an area corresponding to the intermediate electrode 44.

Second Embodiment

Next, a second embodiment of the present teachings will be described below. As it has been mentioned above, the pressure chamber row 8 includes the plurality of pressure chambers 10 being arranged in a row at a constant pitch P1 along the paper feeding direction (refer to FIGS. 2 and 4B). The pitch P1 of the plurality of pressure chambers 10 in a paper transporting direction is set to be constant throughout the length of the pressure chamber row 8. However, in the channel unit 31, since there occurs a dimensional error in the step of stacking the plates 21 to 27, the pitch P1 which is measured practically and a designed pitch do not match necessarily. Therefore, in the second embodiment, the following step is carried out in addition to arranging the intermediate electrodes accurately at the central portions of the pressure chambers by the method described in the first embodiment. In the following description, same reference numerals are assigned to components having a similar structure as in the first embodiment, and description of such components is omitted.

In a method of manufacturing ink-jet head according to the second embodiment, steps namely (a) a step of manufacturing the channel unit 31 and the actuator unit 32 similarly as in the first embodiment, (b) a 'pitch measuring step' of measuring a pitch P2 of the facing portion 44*a* of the plurality of intermediate electrodes 44 in the paper feeding direction (refer to FIG. 4C), and also measuring a pitch P1 in the paper feeding direction of the plurality of pressure chambers 10 (refer to FIG. 4B), (c) a 'combining step' of selecting a combination of the actuator unit 32 and the channel unit 31 for which the pitch P2 of the plurality of intermediate electrodes 44 and the pitch P1 of the plurality of pressure chambers 10 are within a predetermined tolerance, and (d) a 'joining step' of joining the actuator unit 32 and the channel unit 31 according to the combination selected, are executed in order of (a), (b), (c), and (d).

In the abovementioned channel unit producing step and the piezoelectric actuator producing step, a dimensional error occurs at the time of joining the members, and particularly in the actuator unit 32, as it is necessary to set a positional relationship between the plurality of electrodes highly accurately, an effect of the dimensional error on jetting characteristics of the ink is substantial.

In the 'pitch measuring step', the 'pitch P2 of the plurality of intermediate electrodes 44 in the paper feeding direction' which substantially affects the jetting characteristics of the ink is measured, and the 'pitch P1 of the plurality of pressure chambers 10 in the paper feeding direction' corresponding to the pitch P2 is also measured. A reason, why the 'pitch P2 of the plurality of intermediate electrodes 44 in the paper feeding direction' affects the jetting characteristics of the ink substantially will be described below in detail.

As it has been mentioned above, in the actuator unit 32, the first active portions R1 corresponding to the central portions of the pressure chambers 10 are deformed by a drive voltage applied to the first active portions R1 positioned between the upper electrodes 45 and the intermediate electrodes 44, and accordingly, a pressure is applied to a liquid in the pressure chambers 10. Consequently, since the jetting characteristics of the ink in each of the pressure chambers 10 change homogeneously, the first active portions R1 corresponding to the pressure chambers 10 are required to be aligned accurately in the central areas of the pressure chambers 10. When each of the first active portions R1 is shifted substantially from the central area of one of the pressure chamber 10, since a 'ratio of a volume shift' becomes small, the jetting characteristics are degraded. Here, the 'ratio of the volume shift' is a ratio which indicates as to how much it is displaced with respect to an appropriate volume shift. The appropriate volume shift means a volume shift when the volume of the pressure chamber 10 in a jetting operation is shifted appropriately. When the ratio (%) of the volume shift becomes small, since it is not possible to apply a substantial jetting pressure to the ink inside the pressure chamber 10, a jetting speed is lowered, and the jetting characteristics are degraded.

Factors which have an effect on a position shift of the first active portion R1 will be taken into consideration. Firstly, the lower electrode 43 is not an electrode which contributes directly to driving of the first active portion R1, and moreover, is formed to be extended in the paper feeding direction, to have a sufficient width than a width of the pair of pressure chamber rows 8. Therefore, the position shift of the lower electrode 43 does not have an effect on the jetting characteristics. Consequently, the position shift of the lower electrode 43 is not required to be taken into consideration in positioning of the first active portion R1.

Figure 9A:
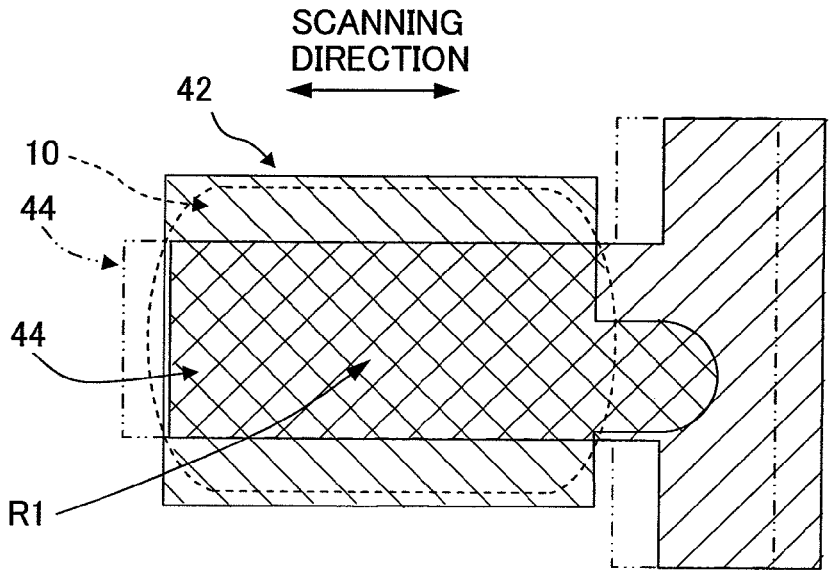
FIG. 9A is a partially enlarged plan view showing a state in which an intermediate electrode is shifted in the scanning direction from an appropriate position.
Figure 9B:
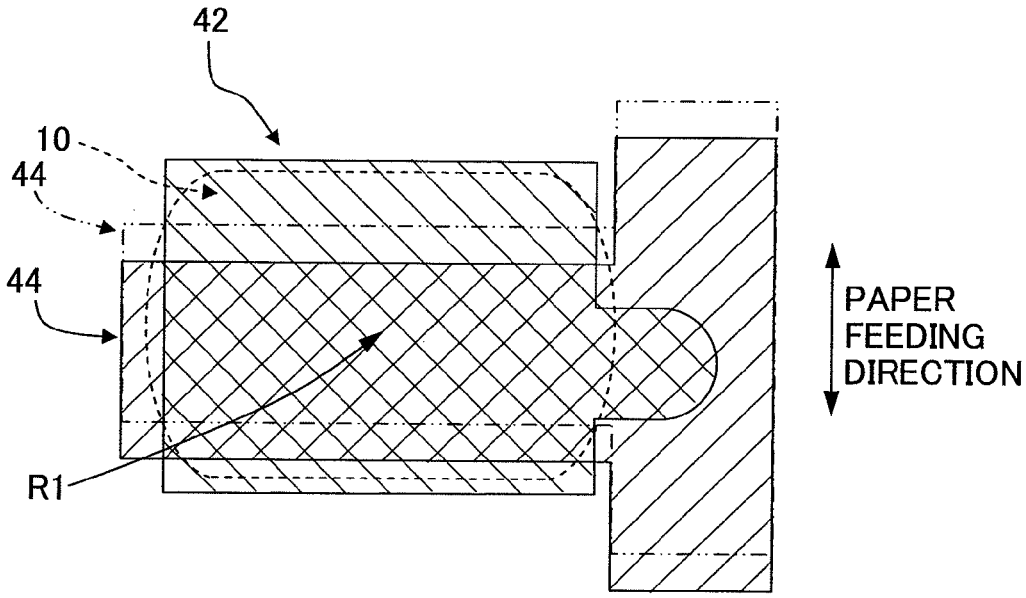
FIG. 9B is a partially enlarged plan view showing a state in which the intermediate electrode is shifted in the paper feeding direction from an appropriate position.
Figure 10A:
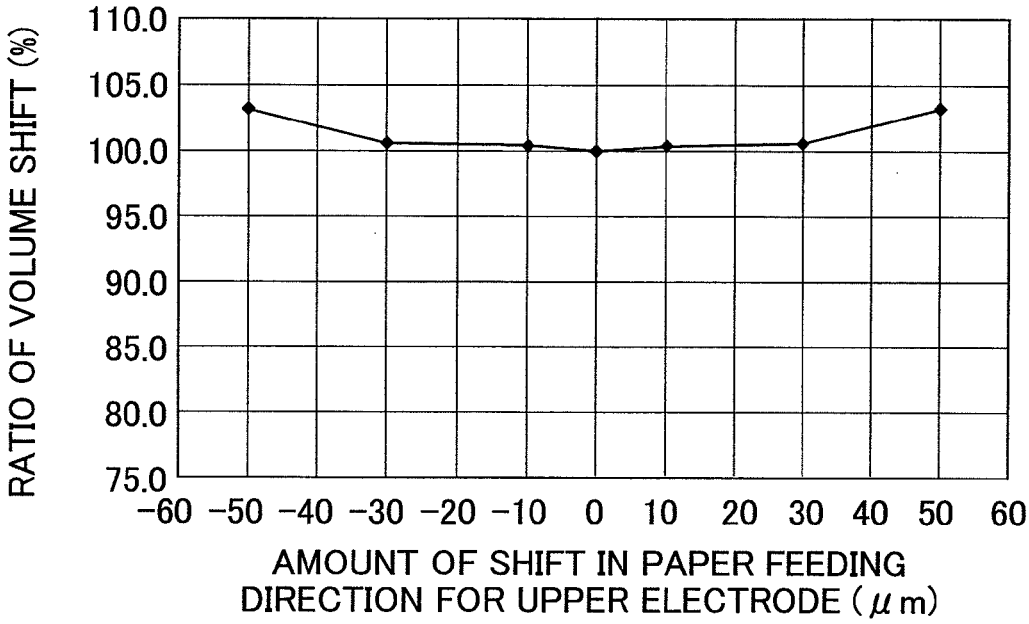
FIG. 10A is a graph showing a relationship of an amount of shift in the paper feeding direction of the upper electrode and a ratio of a volume shift of a pressure chamber.

The upper electrode 45 contributes directly to the driving of the first active portion R1. However, as it has been mentioned above, the length of the upper electrode 45 in the scanning direction is designed to be almost same as the length in the scanning direction of the pressure chamber 10, and the length in the paper feeding direction of the upper electrode 45 is designed to be somewhat longer than the length in the paper feeding direction of the pressure chamber 10. Therefore, even when there is a position shift in the scanning direction of the upper electrode 45 (FIG. 8A), or, even when there is a position shift in the paper feeding direction of the upper electrode 45 (FIG. 8B), there is no fluctuation in the position of the first active portion R1. Consequently, the position shift of the upper electrode 45 is not required to be taken into consideration in the positioning of the first active portion R1. FIG. 10A is a graph in which a change in the 'ratio of volume shift' when there is a position shift of the upper electrode 45 in the paper feeding direction is shown, and it is clear from this graph that the position shift does not have an effect on the 'ration of volume shift'. In FIGS. 8A, 8B, 9A and 9B, each of the upper electrode 45 and the intermediate electrode 44 are shown by oblique lines, and the first active portion R1 is positioned at a portion at which these oblique lines overlap in the form of a lattice. Moreover, alternate long and two short dashes lines in FIGS. 9A and 9B show the position before the position shift.

Figure 10B:
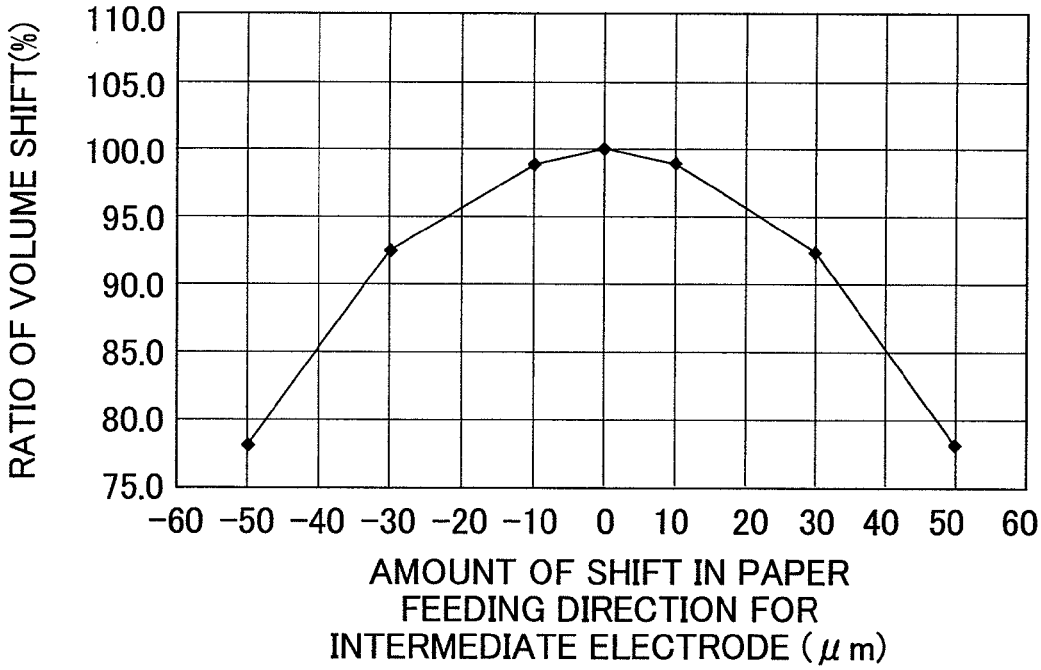
FIG. 10B is a graph showing a relationship of an amount of shift in the paper feeding direction of the intermediate electrode and the ratio of the volume shift of the pressure chamber.

The intermediate electrodes 44 contribute directly to the driving of the first active portion R1. As it has been mentioned above, the plurality of intermediate electrodes 44 are arranged corresponding to the central area of the pressure chambers 10, and in the scanning direction, each of the intermediate electrodes 44 is arranged to be corresponding to the entire length of one of the pressure chambers 10. Therefore, when there is a position shift in the scanning direction of the intermediate electrode 44, as shown in FIG. 9A, the position of the first active portion R1 does not change. Consequently, the position shift in the scanning direction of the intermediate electrode 44 is not required to be taken into consideration in positioning the first active portion R2. However, in the paper feeding direction, the intermediate electrodes 44 are arranged corresponding only to the central area of the pressure chambers 10. Therefore, when there is a position shift in the paper feeding direction of the intermediate electrodes 44, as shown in FIG. 9B, the position of each of the first active portion R1 changes substantially. Moreover, when a range of the change is substantial, the 'ratio of volume shift' of the pressure chambers 10 becomes small, and the jetting characteristics are degraded. FIG. 10B is a graph in which the change in the 'ratio of volume shift' when there is a position shift of the intermediate electrodes 44 in the paper feeding direction is shown, and it is clear from this graph that the position shift has a substantial effect on the 'ratio of volume shift'.

As it has been described above, it is revealed that regarding positioning the first active portion R1, only the 'position shift in the paper feeding direction of the intermediate electrode 44' may be taken into consideration. Therefore, in the 'pitch measuring step', the 'pitch P2 in the paper feeding direction of the plurality of intermediate electrodes 44' in which the position shift is reflected is measured, and the following 'joining step' is carried out based on the pitch P2. In the channel unit producing step and/or the piezoelectric actuator producing step, when a plurality of channel units 31 are formed and/or a plurality of actuator units 32 are formed, the pitch P1 and the pitch P2 are to be measured for all of the produced channel units and/or all of the produced actuator units.

In the 'combining step', the pitch P2 between two of the intermediate electrodes 44 and the pitch P1 between two of the pressure chambers 10 measured in the 'pitch measuring step' are analyzed, and a combination of the actuator unit 32 and the channel unit 31 for which the result of analysis lies within a predetermined tolerance is selected. In the second embodiment, an arrangement is made to select the combination of the actuator unit 32 and the channel unit 31 based on the 'pitch P2 of the plurality of intermediate electrodes 44' in which the 'position shift in the paper feeding direction of the intermediate electrode 44' which has a substantial effect on an accuracy of position of the first active portion R1 is reflected. Therefore, in the 'combining step', it is not necessary to take into consideration a position shift of the other components (such as the upper electrodes 45), and a position shift in the other direction (such as the scanning direction).

In a case of producing the plurality of actuator units 32 in the piezoelectric actuator producing step, an arrangement may be made to select the actuator unit 32 to be combined with the channel unit 31 from among the plurality of actuator units 32, based on the pitch P2 between the intermediate electrodes 44 measured in the 'pitch measuring step'. Moreover, in a case of producing a plurality of channel units 31 and a plurality of the actuator units 32, an arrangement may be made such that the pitch P1 and the pitch P2 is analyzed for each of the channel units 31 and the actuator units 32, and based on 'values of pitch (in other words, distance)' and a 'degree of a variation in the pitch', the channel units 31 and the actuator units 32 are ranked. Then, a combination of the actuator unit 32 and the channel unit 31 which belong to an equivalent rank, is selected.

In the 'joining step', the actuator unit 32 and the channel unit 31 according to the combination which has been selected in the 'combining step' are arranged to face mutually, and by transmitting light to each of the actuator unit 32 and the channel unit 31, a position of a marker (such as a sign which is printed) provided thereon is checked, and the actuator unit 32 and the channel unit 31 are brought in contact such that the marker of the one overlaps with the marker of the other. At this time, an adhesive is applied to a surface of at least one of the actuator unit 18 and the channel unit 16, and the two units are joined by the adhesive. A concrete method for 'positioning' and 'joining' in the 'joining step' is not restricted to the second embodiment, and a conventionally existing method may be selected appropriately and used. Moreover, also for a method of joining the actuator unit 18 and the circuit board 20, a known method can be selected appropriately and used.

In the description made above, the present teachings are applied to the method of manufacturing ink jet head which jets an ink inside the pressure chamber. However, the application of the present teachings is not restricted to the above-mentioned application. For instance, the present teachings are also applicable to a method of manufacturing liquid transporting apparatus which transports a liquid in liquid transporting channels including a pressure chamber, by applying a pressure to the liquid inside the pressure chamber, such as a liquid jetting head which jets a liquid other than ink from nozzles.

What is claimed is:

1. A method of manufacturing a liquid transporting apparatus which transports a liquid, comprising:

providing a channel unit in which liquid transporting channels, each including a pressure chamber, are formed;

providing a piezoelectric actuator which applies a pressure to the liquid in the pressure chambers, including:

providing a piezoelectric layer having, for each pressure chamber, a first active portion corresponding to a central portion of the pressure chamber, and a corresponding second active portion corresponding to a portion at an outer periphery of the central portion of the pressure chamber; and arranging a, plurality of individual electrodes to each of which a first electric potential and a second electric potential different from the first electric potential are applied selectively and each corresponding to one of the pressure chambers, a first constant electric potential electrode to which the first electric potential is applied, and a second constant electric potential electrode to which the second electric potential is applied, such that each first active portion is sandwiched between one of the individual electrodes and the first constant electric potential electrode, and that each corresponding second active portion is sandwiched between the same individual electrode and the second constant electric potential electrode; and joining the channel unit and the piezoelectric actuator by positioning the first constant electric potential electrode of the piezoelectric actuator to be overlapped with the central portions of the pressure chambers of the channel unit;

wherein the plurality of individual electrodes is arranged on a first plane.

2. The method of manufacturing the liquid transporting apparatus according to claim 1;

wherein the piezoelectric layer is formed of a material through which light is transmitted; and wherein, upon joining the channel unit and the piezoelectric actuator, a position of the first constant electric potential electrode is detected by irradiating a light toward the piezoelectric actuator, and the first constant electric potential electrode is positioned to be overlapped with the central portions of the pressure chambers of the channel unit.

3. The method of manufacturing the liquid transporting apparatus according to claim 1;

wherein, upon providing the piezoelectric actuator, a first mark is formed in an area, of the piezoelectric actuator, at a position located away from a position on the first constant electric potential electrode, corresponding to the center of a certain pressure chamber, by a distance in one direction parallel to a surface of the piezoelectric actuator which is to be joined to the channel unit, the area being different from an area in which the individual electrode corresponding to the certain pressure chamber, the first constant electric potential electrode, and the second constant electric potential electrode are formed; and wherein, upon joining the channel unit and the piezoelectric actuator, the first constant electric potential electrode is positioned to be overlapped with the central portions of the pressure chambers of the channel unit, based on the position of the first mark from which a position of the first constant electric potential electrode is calculatable.

4. The method of manufacturing the liquid transporting apparatus according to claim 3;

wherein, upon providing the channel unit, a second mark which is away from the center of the certain pressure chamber by the distance in the one direction is formed on the channel unit; and wherein, upon joining the channel unit and the piezoelectric actuator, the first mark is positioned to be overlapped with the second mark.

5. The method of manufacturing the liquid transporting apparatus according to claim 4;

wherein the channel unit is formed by a plurality of stacked plates; and wherein the second mark is formed as a through hole penetrating through the stacked plates.

6. The method of manufacturing the liquid transporting apparatus according to claim 5;

wherein, at the time of joining the channel unit and the piezoelectric actuator, a light is irradiated toward the through hole in a direction from the channel unit toward the piezoelectric actuator, and the first mark and the through hole are aligned by the light which is passed through the through hole and is transmitted through the piezoelectric actuator.

7. The method of manufacturing the liquid transporting apparatus according to claim 3;

wherein the piezoelectric actuator includes a first piezoelectric sheet on which the first constant electric potential electrode is formed, a second piezoelectric sheet on which the second constant electric potential electrode is formed, and a third piezoelectric sheet on which the individual electrodes are formed, the first, second and third piezoelectric sheets being stacked; and wherein the first mark is formed on the first piezoelectric sheet.

8. The method of manufacturing the liquid transporting apparatus according to claim 1;

wherein the plurality of pressure chambers is arranged in a row in a row direction; and wherein the first constant electric potential electrode is formed as a plurality of first constant electric potential electrodes arranged in a row in the row direction, corresponding to the pressure chambers; and wherein the method of manufacturing the liquid transporting apparatus further comprises:

measuring a pitch of the first constant electric potential electrodes in the row direction, and measuring a pitch of the pressure chambers in the row direction;

selecting a combination of the actuator unit and the channel unit for which the pitch of the first constant electric potential electrodes and the pitch of the pressure chambers is within a tolerance; and joining the actuator unit and the channel unit based oil the selected combination upon joining the channel unit and the piezoelectric actuator.

9. The method of manufacturing the liquid transporting apparatus according to claim 8;

wherein the pitch of the first constant electric potential electrodes and the pitch of the pressure chambers in a direction orthogonal to the row direction is not measured, and is not taken into consideration upon selecting the combination of the actuator unit and the channel unit.

10. The method of manufacturing the liquid transporting apparatus according to claim 8;

wherein, upon providing the piezoelectric actuator, a plurality of piezoelectric actuators is provided;

wherein, upon measuring the pitch of the first constant electric potential electrodes in the row direction, pitches of the first constant electric potential electrodes in the row direction are measured for all of the piezoelectric actuators; and wherein, upon selecting the combination of the actuator unit and the channel unit, a piezoelectric actuator to be combined with the channel unit is selected from the piezoelectric actuators, based on the measured pitch of the first constant electric potential electrodes.

11. The method of manufacturing the liquid transporting apparatus according to claim 8;

wherein, upon providing the piezoelectric actuator and the channel unit, a plurality of piezoelectric actuators and a plurality of channel units are provided, and wherein, upon measuring the pitch in the row direction, pitches are measured for all of the piezoelectric actuators and all of the channel units, and the piezoelectric actuators and the channel units are ranked in a plurality of ranks, respectively, based on the measured pitches; and wherein, upon selecting the combination of the actuator unit and the channel unit, a piezoelectric actuator ranked in a rank and a channel unit ranked in an equivalent rank equivalent to the rank of the piezoelectric actuator are combined.

* * * * *